US007790254B2

(12) United States Patent
Webb et al.

(10) Patent No.: US 7,790,254 B2
(45) Date of Patent: Sep. 7, 2010

(54) SYSTEM AND METHOD OF REINFORCING DIVERTER SWITCHES

(75) Inventors: Geoff Webb, McKinney, TX (US); Douglas Riggins, Dallas, TX (US); John Pruente, Keller, TX (US)

(73) Assignee: Waukesha Electric Systems, Inc., Waukesha, WI (US)

( * ) Notice: Subject to any disclaimer, the term of this patent is extended or adjusted under 35 U.S.C. 154(b) by 532 days.

(21) Appl. No.: 11/783,345

(22) Filed: Apr. 9, 2007

(65) Prior Publication Data

US 2007/0253786 A1 Nov. 1, 2007

Related U.S. Application Data

(60) Provisional application No. 60/789,888, filed on Apr. 7, 2006.

(51) Int. Cl.
*B28B 23/00* (2006.01)

(52) U.S. Cl. ..... 428/36.4; 406/183; 406/197

(58) Field of Classification Search ..... 428/35.7, 428/36.1, 36.9, 36.92, 297.4, 36.4; 406/183, 406/197

See application file for complete search history.

(56) References Cited

U.S. PATENT DOCUMENTS 5,744,764 A * 4/1998 Aschenbrenner et al. .... 200/1 R

* cited by examiner

*Primary Examiner*—Michael C Miggins
(74) *Attorney, Agent, or Firm*—Baker & Hostetler LLP

(57) ABSTRACT

A reinforced diverter switch is molded with a flange having a reinforcing material embedded therein. A shaft of a diverter switch is wrapped with a reinforcing material. The shaft of the diverter switch may be wrapped by first removing a portion of the epoxy resin to expose a conductor of the diverter switch, machining a portion of the epoxy resin, and then filament winding the reinforcing material over the portion of the epoxy resin machined.

18 Claims, 2 Drawing Sheets

SYSTEM AND METHOD OF REINFORCING DIVERTER SWITCHES

CROSS-REFERENCE TO RELATED APPLICATIONS

This application claims benefit of U.S. Provisional Patent Application No. 60/789,888 titled, SYSTEM AND METHOD OF REINFORCING DIVERTER SWITCHES, filed Apr. 7, 2006, which is hereby incorporated herein by reference in its entirety.

FIELD OF THE INVENTION

The invention relates generally to reinforcing flanges and shafts of diverter switches. More particularly, the invention relates to reinforcing diverter switch flanges by embedding the flange with a reinforcing material and wrapping the shafts with a reinforcing material.

BACKGROUND OF THE INVENTION

Diverter switches are known. Diverter switches are components of a tap changer of a power transformer. Diverter switches transfer current from one voltage tap to another based on a tap selected by a tap selector. Diverter switches and tap selectors are the only internal moving parts in a transformer. The diverter switch does the entire on load making and breaking of currents, whereas the tap selector pre-selects the tap to which the diverter switch will transfer the load current.

Diverter switches, however, typically are fragile. Diverter switches have flanges that break fairly easily. For example, much care is needed to install diverter switches because a slight amount of excess pressure applied to a flange may cause the flange to break. Additionally, shafts of diverter switches are also fragile. The shafts are also susceptible to breakage and shaft housings may crack during lead installation. This results in having to obtain a replacement diverter switch which incurs additional costs, time, and resources. Diverter switches are typically formed with a hardener such as, for example, an epoxy resin, however, the hardeners do not provide sufficient rigidity to reinforce the shafts of diverter switches.

These and other drawbacks exist with current diverter switches.

SUMMARY OF THE INVENTION

A system and method of reinforcing diverter switches is provided. According to one embodiment of the invention, a diverter switch is molded with a flange having a reinforcing material embedded therein. Preferably, the reinforcing material is fiberglass although other suitable reinforcing materials may be used.

In accordance with another embodiment of the invention, a shaft of a diverter switch is wrapped with a reinforcing material. Preferably, the reinforcing material is fiberglass although other suitable reinforcing materials may be used. A shaft of a diverter switch typically includes a hardener such as, for example, an epoxy resin. The hardener, however, typically does not provide sufficient rigidity as discussed above. The shaft of the diverter switch may be wrapped by first removing a portion of the epoxy resin to expose a conductor of the diverter switch. A portion of the epoxy resin is then machined. A reinforcing material is filament wound over the portion of the epoxy resin machined.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
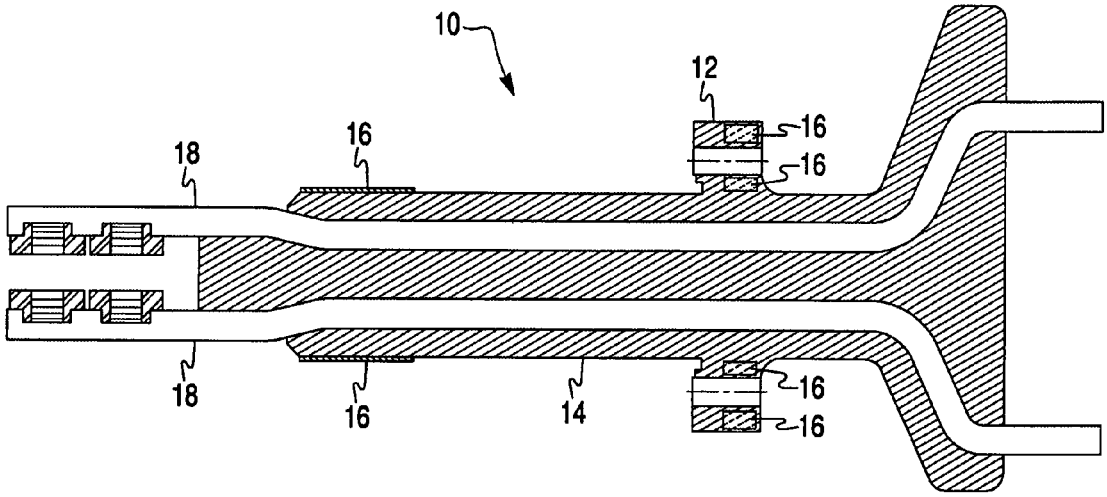
FIG. 1 is a cross-sectional side view of a reinforced diverter switch according to one embodiment of the invention.

The invention will now be described with reference to the drawing figures, in which like reference numerals refer to like parts throughout. An embodiment in accordance with the invention provides a reinforced diverter switch having a flange embedded with a reinforcing material and a shaft wrapped with a reinforcing material.

Figure 2:
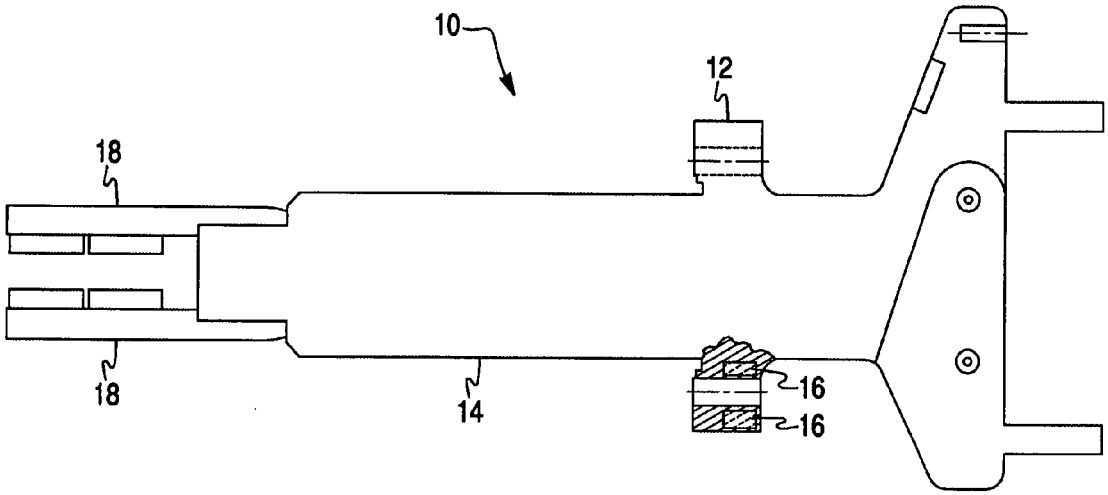
FIG. 2 is a side view with a partial cross-section of a reinforced diverter switch according to one embodiment of the invention.

FIGS. 1 and 2 illustrate a reinforced diverter switch 10 according to one embodiment of the invention. The diverter switch 10 includes reinforced flange 12 and shaft 14. The flange 12 includes a reinforcing material 16 embedded therein. The reinforcing material 16 may be, for example, fiberglass, although other suitable reinforcing materials may be used. The flange 12 may be formed by molding the diverter switch 10 and embedding the reinforcing material 16 during a molding process. The reinforcing material 16 extends through at least a portion of a length of the flange 12, however, preferably, the reinforcing material 16 extends throughout an entire length of the flange 12.

The reinforcing material 16 serves to provide additional rigidity to the flange 12. This reduces a likelihood that the flange 12 may break during, for example, installation of the diverter switch 10 into a transformer. The reinforcing material 16 helps to reduce costs, time, and resources necessary for replacing a diverter switch having a broken flange.

The diverter switch 10 also includes a reinforced shaft 14. Typically, diverter switches 10 include a hardener such as, for example, an epoxy resin, that serves to form a shape of the diverter switch 10. The hardener, however, does not provide sufficient rigidity to reduce a likelihood of breakage or cracking.

Figure 3:
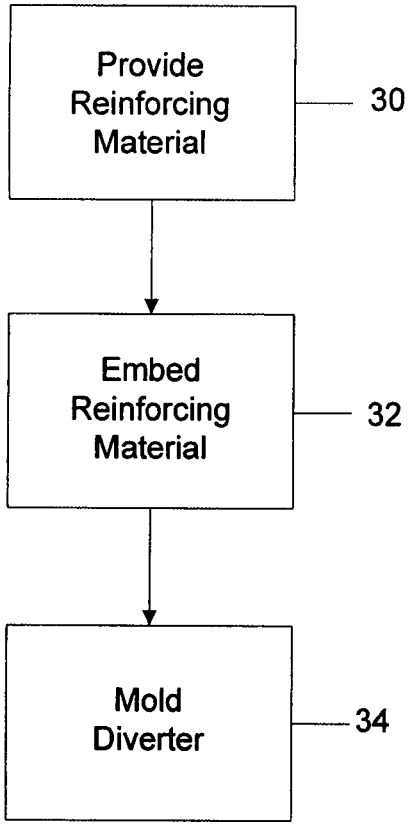
FIG. 3 is a flowchart illustrating a method of reinforcing a diverter switch according to one embodiment of the invention.

FIG. 3 illustrates a method of reinforcing a flange of a diverter switch according to one embodiment of the invention. Initially, a reinforcing material is provided for embedding in the flange of the diverter switch, step 30. The reinforcing material is preferably fiberglass, although other materials may also be used. The reinforcing material is embedded in the flange, step 32, to increase a rigidity of the flange. The diverter switch is then molded as desired, step 34.

Figure 4:
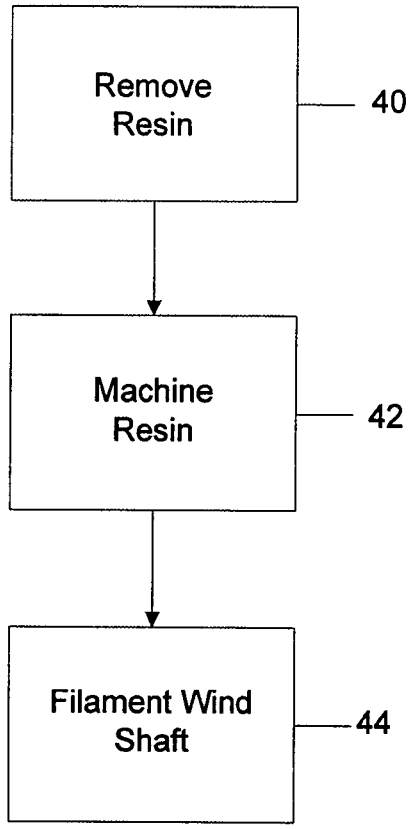
FIG. 4 is a flowchart illustrating a method of reinforcing a diverter switch according to one embodiment of the invention.

According to the invention, the shaft 14 may be reinforced by wrapping the reinforcing material 16 about a least a portion thereof. FIG. 4 illustrates a method of reinforcing the shaft 14 of a diverter switch 10. According to one embodiment of the invention, a portion of the epoxy resin is removed to expose a conductor 18 of the diverter switch 10 as illustrated in step 40. A portion of the epoxy resin is then machined about a portion of the shaft 14 as illustrated in step 42. This machined portion of the shaft 14 is wrapped with the reinforcing material 16 as illustrated in step 44. According to one embodiment of the invention, the shaft 14 is wrapped by filament winding. As stated above, the reinforcing material is preferably fiberglass although other suitable reinforcing materials may be used.

The reinforcing material 16 wrapped around the shaft 14 of the diverter switch provides additional rigidity. This additional rigidity reduces a likelihood of the shaft 14 cracking during, for example, lead installation.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method of reinforcing a diverter comprising:

forming a diverter having a conductor, flange, and a shaft; and embedding the flange with a reinforcing material.

2. The method of claim 1, wherein the reinforcing material comprises fiberglass.

3. The method of claim 1, wherein the diverter is formed by molding.

4. The method of claim 1, further comprising wrapping at least a portion of the shaft with the reinforcing material.

5. The method of claim 4, wherein the reinforcing material comprises fiberglass.

6. The method of claim 1, wherein the diverter comprises an epoxy resin.

7. The method of claim 6, wherein a portion of the epoxy resin is removed from the conductor.

8. The method of claim 6, further comprising machining a portion of the epoxy resin.

9. The method of claim 8, further comprising filament winding a reinforcing material over at least a portion of the machined epoxy resin.

10. A reinforced diverter comprising:

a conductor; and flange attached to the conductor; and a shaft attached to the conductor, wherein the flange is embedded with a reinforcing material.

11. The diverter of claim 10, wherein the reinforcing material comprises fiberglass.

12. The diverter of claim 10, wherein the diverter is formed by molding.

13. The divert of claim 10, wherein the shaft is at least partially wrapped with the reinforcing material.

14. The diverter of claim 13, wherein the reinforcing material comprises fiberglass.

15. The diverter of claim 10, wherein the diverter comprises an epoxy resin.

16. The diverter of claim 15, wherein at least a portion of the epoxy resin is removed from the conductor.

17. The diverter of claim 15, wherein at least a portion of the epoxy resin is machined.

18. The diverter of claim 17, further comprising a filament wind over at least a portion of the machined epoxy resin.

* * * * *

UNITED STATES PATENT AND TRADEMARK OFFICE

CERTIFICATE OF CORRECTION

PATENT NO. : 7,790,254 B2
APPLICATION NO. : 11/783345
DATED : September 7, 2010
INVENTOR(S) : Webb et al.

It is certified that error appears in the above-identified patent and that said Letters Patent is hereby corrected as shown below:

In the Claims

Claim 10, column 4, line 24, delete "and"; and

Claim 10, column 4, line 25, delete "flange" and insert -- a flange -- therefore.

Signed and Sealed this

Second Day of November, 2010

David J. Kappos

David J. Kappos
*Director of the United States Patent and Trademark Office*